United States Patent [19]

Ono et al.

[11] Patent Number: 4,952,064

[45] Date of Patent: Aug. 28, 1990

[54] METHOD FOR PREPARING MAGNETIC COATING COMPOSITIONS

[75] Inventors: Toshio Ono; Chiaki Mizuno; Yasuo Tamai; Hiroshi Ogawa, all of Kanagawa, Japan

[73] Assignee: Fuji Photo Film Co., Ltd., Kanagawa, Japan

[21] Appl. No.: 459,174

[22] Filed: Dec. 29, 1989

[30] Foreign Application Priority Data

Dec. 29, 1988 [JP] Japan ..... 63-330867
Dec. 29, 1988 [JP] Japan ..... 63-330868

[51] Int. Cl.[5] ..... B28C 7/04; B01F 7/02

[52] U.S. Cl. ..... 366/76; 366/97; 366/301

[58] Field of Search ..... 366/76, 79, 83, 84, 366/85, 96, 97, 297, 301, 160

[56] References Cited

U.S. PATENT DOCUMENTS 2,670,188 2/1954 Erdmenger ..... 366/97
4,343,929 8/1982 Sugio ..... 366/85

*Primary Examiner*—Robert W. Jenkins

*Attorney, Agent, or Firm*—Sughrue, Mion, Zinn, Macpeak & Seas

[57] ABSTRACT

A single two-shaft continuous kneading and mixing machine, which is provided with a pair of shafts having blade members secured thereto, and a barrel accommodating the shafts such that they can be rotated, carries out kneading of a mixture of magnetic grains and a solution, which contains a binder in an organic solvent, in a normal kneading region and thereafter carries out dilution kneading of the mixture, which resulted after kneading in the normal kneading region was carried out, and an organic solvent in a dilution kneading region. The solids concentration in the mixture subjected to kneading in the normal kneading region is adjusted so that it falls within the range of 65 to 95 wt %. The solids concentration in the mixture subjected to dilution kneading is adjusted so that it falls within the range of 30 to 60 wt %. The width of a gap between blade members, which are secured to different shafts and which face each other, and the width of a gap between each blade member and the inner surface of the barrel in the dilution kneading region are made smaller than the widths of corresponding gaps in the normal kneading region.

18 Claims, 5 Drawing Sheets

METHOD FOR PREPARING MAGNETIC COATING COMPOSITIONS

BACKGROUND OF THE INVENTION

1. Field of the Invention

This invention relates to a method for preparing a magnetic coating composition which is used to form magnetic layers of magnetic recording media such as magnetic tapes and magnetic disks.

2. Description of the Prior Art

In order to obtain magnetic recording media which exhibit excellent magnetic characteristics, electromagnetic transducing characteristics, or the like, it is necessary to improve the packing density of magnetic grains in the magnetic coating composition which is applied to the substrates of the magnetic recording media. For this purpose, when a magnetic coating composition is prepared, magnetic grains and a solution which contains a binder in an organic solvent should be kneaded at high concentrations and under a high shearing force. In order for this requirement to be satisfied, a technique wherein a two-shaft continuous kneading and mixing machine kneads the magnetic grains and the solution has been disclosed in, for example, Japanese Unexamined Patent Publication No. 62(1987)-41274. Hereinbelow, this type of kneading is referred to as "normal kneading."

In general, magnetic coating compositions are prepared, after the magnetic grains and the solution which contains a binder in an organic solvent have been kneaded, an organic solvent is added to the resulting kneaded mixture in order to dilute it. However, the kneaded mixture obtained from a two-shaft continuous kneading and mixing machine has a high viscosity. If such a mixture having a high viscosity is diluted at a stretch in a flow jet mixture as disclosed in Japanese Unexamined Patent Publication No. 62(1987)-41274, a high shearing force cannot be imparted thereto. Therefore, small lumps remain in the mixture after it has been diluted, and a uniformly diluted mixture cannot be obtained. Also, it takes such a long time to disperse the diluted mixture that even if the diluted mixture is subjected to dispersion processing, it cannot be dispersed to a large extent. When a magnetic coating composition prepared in this manner is applied to substrates, magnetic recording media which exhibit excellent magnetic characteristics, electromagnetic transducing characteristics, or the like, cannot be obtained.

In cases where the kneading and the dilution are sequentially carried out with a two-shaft continuous kneading and mixing machine, instead of the dilution being carried out at a stretch, dilution can be effected gradually. With "dilution kneading," a certain level of shearing force is applied to the kneaded mixture and an organic solvent is added thereto. This process results in the viscosity of the kneaded mixture becoming lower as it is kneaded and diluted. Accordingly, in cases where an ordinary type of two-shaft continuous kneading and mixing machine is directly used to carry out dilution kneading, the problems described below arise. Specifically, a two-shaft continuous kneading and mixing machine comprises a pair of shafts which are spaced a predetermined distance apart from each other and which extend in parallel, a plurality of blade members which are secured to each of the shafts at specific intervals along the axis of each shaft, and a barrel in which the blade members secured to the shafts are accommodated. Shearing force is given to a kneaded mixture in the gaps formed between each pair of blade members, a pair of blade members being made up of blades which are secured to different shafts and which face each other, and in the gaps formed between each blade member and the inner surface of the barrel. If the widths of the gaps are set to values suitable for normal kneading, they will be unsuitable and excessively large for dilution kneading because a kneaded mixture with a decreasing viscosity must be processed. Therefore a high shearing force will not be given to the mixture as it is being kneaded and diluted. Also, the mixture obtained at the time normal kneading is finished has a markedly different viscosity from the organic solvent, which is to be added thereto, and therefore small lumps can easily remain in the diluted mixture. The small lumps, which have the consistency of the undiluted mixture, pass through the aforesaid gaps without being sheared. (This phenomenon will hereinbelow be referred to as the short pass phenomenon.) Therefore, a uniformly diluted mixture cannot be obtained. If the aforesaid gaps are made narrow enough for dilution kneading to be effected properly, a very high load is placed on the blade members during normal kneading, which makes it impossible for normal kneading to be carried out smoothly.

SUMMARY OF THE INVENTION

The primary object of the present invention is to provide a method for preparing a magnetic coating composition wherein a single two-shaft continuous kneading and mixing machine may be used to carry out normal kneading and dilution kneading, and a uniformly diluted mixture can be obtained.

Another object of the present invention is to provide a method for preparing a magnetic coating composition wherein two two-shaft continuous kneading and mixing machines are used to carry out normal kneading and dilution kneading, respectively, and a uniformly diluted mixture can be obtained.

The present invention provides a first method for preparing a magnetic coating composition wherein a single two-shaft continuous kneading and mixing machine, which is provided with a pair of shafts having blade members secured thereto and a barrel accommodating the shafts such that they can rotate, is used to carry out normal kneading of a mixture of magnetic grains and a solution which contains a binder in an organic solvent in a normal kneading region and thereafter to carry out dilution kneading of the mixture, which results from normal kneading, and an organic solvent in a dilution kneading region, wherein the improvement comprises the steps of:

(i) in the course of said normal kneading being carried out, adjusting the solids concentration in the mixture subjected to said normal kneading so that the solids concentration falls within the range of 65 to 95 wt%, (ii) in the course of said dilution kneading being carried out, adjusting the solids concentration in the mixture subjected to said dilution kneading so that the solids concentration falls within the range of 30 to 60 wt%, (iii) adjusting the widths of gaps in said dilution kneading region of said two-shaft continuous kneading and mixing machine, each of which gaps is formed between a blade member secured to one of said shafts and a blade member secured to the other shaft, said blade members being positioned such that they face each other, so that they are smaller than the widths of such gaps in said normal kneading region of said two-shaft continuous kneading and mixing machine, and (iv) adjusting the widths of gaps in said dilution kneading region of said two-shaft continuous kneading and mixing machine, each of which gaps is formed between each blade member and the inner surface of said barrel, so that they are smaller than the widths of such gaps in said normal kneading region of said two-shaft continuous kneading and mixing machine.

The term "solids" as used herein means magnetic grains, the binder, a nonmagnetic material, and other solid materials.

In the first method for preparing a magnetic coating composition in accordance with the present invention, in the course of normal kneading being carried out in the normal kneading region of the two-shaft continuous kneading and mixing machine, the solids concentration in the mixture subjected to normal kneading is adjusted so that it falls within the range of 65 to 95 wt%. This range of the solids concentration in the mixture subjected to normal kneading is defined in order to ensure that a mixture is obtained which can be kneaded well. Specially, if the solids concentration in the mixture of the magnetic grains, the binder, and the like, which mixture is subjected to normal kneading, is made lower than 65 wt%, the viscosity of the mixture becomes excessively low, and therefore a high shearing force cannot be applied to the mixture. Therefore, the solids also cannot be dispersed uniformly, If the solids concentration in the mixture subjected to normal kneading is made higher than 95 wt%, the viscosity of the mixture becomes excessively high, and the mixture cannot be kneaded uniformly. The solids concentration in the mixture subjected to normal kneading should preferably fall within the range of 75 to 90 wt%.

Also, in the course of dilution kneading being carried out in the dilution kneading region of the two-shaft continuous kneading and mixing machine, the solids concentration in the mixture subjected to dilution kneading is adjusted so that it falls within the range of 30 to 60 wt%. If the solids concentration in the mixture subjected to dilution kneading is made lower than 30 wt%, the viscosity of the mixture becomes excessively low, and the solids cannot be dispersed uniformly. If the solids concentration in the mixture subjected to dilution kneading is made higher than 60 wt%, the viscosity of the mixture becomes excessively high, and the mixture cannot be dispersed efficiently and uniformly. The solids concentration in the mixture subjected to dilution kneading should preferably fall within the range of 40 to 55 wt%.

The widths of the gaps in the dilution kneading region of the two-shaft continuous kneading and mixing machine, each of which gaps is formed between a blade member secured to one of the shafts and a blade member secured to the other shaft, said blade members being positioned such that they face each other, are not limited to specific values insofar as the widths are smaller than the widths of such gaps in the normal kneading region of the two-shaft continuous kneading and mixing machine. However, the widths of said gaps in the dilution kneading region of the two-shaft continuous kneading and mixing machine should preferably be 50% to 80% of the widths of such gaps in the normal kneading region of the two-shaft continuous kneading and mixing machine.

Also, the widths of the gaps in the dilution kneading region of the two-shaft continuous kneading and mixing machine, each of which gaps is formed between each blade member and the inner surface of the barrel, are not limited to specific values insofar as they are smaller than the widths of such gaps in the normal kneading region of the two-shaft continuous kneading and mixing machine. However, the widths of said gaps in the dilution kneading region of the two-shaft continuous kneading and mixing machine should preferably be 50% to 80% of the widths of such gaps in the normal kneading region of the two-shaft continuous kneading and mixing machine.

As described above, in the first method for preparing a magnetic coating composition in accordance with the present invention, the solids concentration in the mixture subjected to normal kneading and the solids concentration in the mixture subjected to dilution kneading are adjusted so that they fall within predetermined ranges. Also, the widths of the gaps formed between each pair of blade members, which are secured to different shafts and which face each other, in the dilution kneading region of the two-shaft continuous kneading and mixing machine are made smaller than the widths of such gaps in the normal kneading region of the two-shaft continuous kneading and mixing machine. Additionally, the widths of the gaps, which are formed between each blade member and the inner surface of the barrel, in the dilution kneading region of the two-shaft continuous kneading and mixing machine are made smaller than the widths of such gaps in the normal kneading region of the two-shaft continuous kneading and mixing machine. Therefore, in the course of dilution kneading being carried out on a mixture having a viscosity lower than the viscosity of the mixture which is kneaded in the normal kneading region, the mixture subjected to dilution kneading can be processed under a high shearing force. Also, the short pass phenomenon can be prevented from occurring, and a uniformly diluted mixture can be obtained.

With the first method for preparing a magnetic coating composition in accordance with the present invention, a uniformly diluted mixture can be obtained from a single two-shaft continuous kneading and mixing machine which carries out both normal kneading and dilution kneading. Therefore, the diluted mixture can then be dispersed quickly and to a large extent. When a magnetic coating composition obtained in this manner is applied to substrates, it is possible to obtain magnetic recording media which exhibit excellent magnetic characteristics, electromagnetic transducing characteristics, or the like.

The present invention also provides a second method for preparing a magnetic coating composition wherein a first one of two two-shaft continuous kneading and mixing machines, each of which is provided with a pair of shafts having blade members secured thereto and a barrel accommodating the shafts such that they can be rotated, is used to carry out normal kneading of a mixture of magnetic grains and a solution which contains a binder in an organic solvent, and a second one of the two two-shaft continuous kneading and mixing machines is used to carry out dilution kneading of a mixture, which results from normal kneading, and an organic solvent, wherein the improvement comprises the steps of:

(i) in the course of said normal kneading being carried out in said first two-shaft continuous kneading and mixing machine, adjusting the solids concentration in the mixture subjected to said kneading so that the solids concentration falls within the range of 65 to 95 wt%, (ii) in the course of said dilution kneading being carried out in said second two-shaft continuous kneading and mixing machine, adjusting the solids concentration in the mixture subjected to said dilution kneading so that the solids concentration falls within the range of 30 to 60 wt%, (iii) adjusting the widths of gaps in said second two-shaft continuous kneading and mixing machine, each of which gaps is formed between a blade member secured to one of said shafts and a blade member secured to the other shaft, said blade members being positioned such that they face each other, so that they are smaller than the widths of such gaps in said first two-shaft continuous kneading and mixing machine, and (iv) adjusting the widths of gaps in said second two-shaft continuous kneading and mixing machine, each of which gaps is formed between each blade member and the inner surface of said barrel, so that they are smaller than the widths of such gaps in said first two-shaft continuous kneading and mixing machine.

In the second method for preparing a magnetic coating composition in accordance with the present invention, in the course of normal kneading being carried out in the first two-shaft continuous kneading and mixing machine, the solids concentration in the mixture subjected to normal kneading is made to fall within the range of 65 to 95 wt%. This range of solids concentration in the mixture subjected to normal kneading is defined in order to ensure that a mixture is obtained which will be kneaded well. Specifically, as described above, if the solids concentration in the mixture of the magnetic grains, the binder, and the like, which mixture is subjected to normal kneading, is made lower than 65 wt%, the viscosity of the mixture becomes excessively low, and a high shearing force cannot be given to the mixture. Therefore, the solids will not be dispersed uniformly. If the solids concentration in the mixture subjected to normal kneading is made higher than 95 wt%, the viscosity of the mixture becomes excessively high, and the mixture cannot be kneaded uniformly. The solids concentration in the mixture subjected to normal kneading should preferably fall within the range of 75 to 90 wt%.

Also, in course of dilution kneading being carried out in the second two-shaft continuous kneading and mixing machine, the solids concentration in the mixture subjected to dilution kneading is made to fall within the range of 30 to 60 wt%. As described above, if the solids concentration in the mixture subjected to dilution kneading is made lower than 30 wt%, the viscosity of the mixture becomes excessively low, and the solids will not be dispersed uniformly. If the solids concentration in the mixture subjected to the dilution kneading is made higher than 60 wt%, the viscosity of the mixture becomes excessively high, and the mixture will not be dispersed efficiently and uniformly. The solids concentration in the mixture subjected to dilution kneading should preferably fall within the range of 40 to 55 wt%.

The widths of the gaps in the second two-shaft continuous kneading and mixing machine, each of which gaps is formed between a blade member secured to one of the shafts and a blade member secured to the other shaft, said blade members being positioned so that they face each other, are not limited to specific values insofar as they are smaller than the widths of such gaps in the first two-shaft continuous kneading and mixing machine. However, the widths of said gaps in the second two-shaft continuous kneading and mixing machine should preferably be 50% to 80% of the widths of such gaps in the first two-shaft continuous kneading and mixing machine.

Also, the widths of gaps in the second two-shaft continuous kneading and mixing machine, each of which gaps is formed between each blade member and the inner surface of the barrel, are not limited to specific values insofar as they are smaller than the widths of such gaps in the first two-shaft continuous kneading and mixing machine. However, the widths of said gaps in the second two-shaft continuous kneading and mixing machine should preferably be 50% to 80% of the widths of such gaps in the first two-shaft continuous kneading and mixing machine.

As described above, in the second method for preparing a magnetic coating composition in accordance with the present invention, the solids concentration in the mixture subjected to normal kneading and the solids concentration in the mixture subjected to dilution kneading are made to fall within predetermined ranges. Also, the widths of the gaps formed between each pair of blade members, which are secured to different shafts and positioned such that they face each other, in the second two-shaft continuous kneading and mixing machine which carries out dilution kneading, are made smaller than the widths of such gaps in the first two-shaft continuous kneading and mixing machine which carries out normal kneading. Additionally, the widths of the gaps, which are formed between each blade member and the inner surface of the barrel, in the second two-shaft continuous kneading and mixing machine are made smaller than the widths of such gaps in the first two-shaft continuous kneading and mixing machine. Therefore, in the course of dilution kneading being carried out in the second two-shaft continuous kneading and mixing machine on a mixture having a viscosity lower than the viscosity of the mixture which is kneaded in the first two-shaft continuous kneading and mixing machine, the mixture subjected to dilution kneading can be processed under a high shearing force. Also, the short pass phenomenon can be prevented from occurring, and a uniformly diluted mixture can be obtained.

With the second method for preparing a magnetic coating composition in accordance with the present invention, a uniformly diluted mixture can be obtained from a process wherein two two-shaft continuous kneading and mixing machines respectively carry out normal kneading and dilution kneading. Therefore, the diluted mixture can then be dispersed quickly and to a large extent. When a magnetic coating composition obtained in this manner is applied to substrates, it is possible to obtain magnetic recording media which exhibit excellent magnetic characteristics, electromagnetic transducing characteristics, or the like.

DESCRIPTION OF THE PREFERRED EMBODIMENTS

The present invention will hereinbelow be described in further detail with reference to the accompanying drawings.

Figure 1:
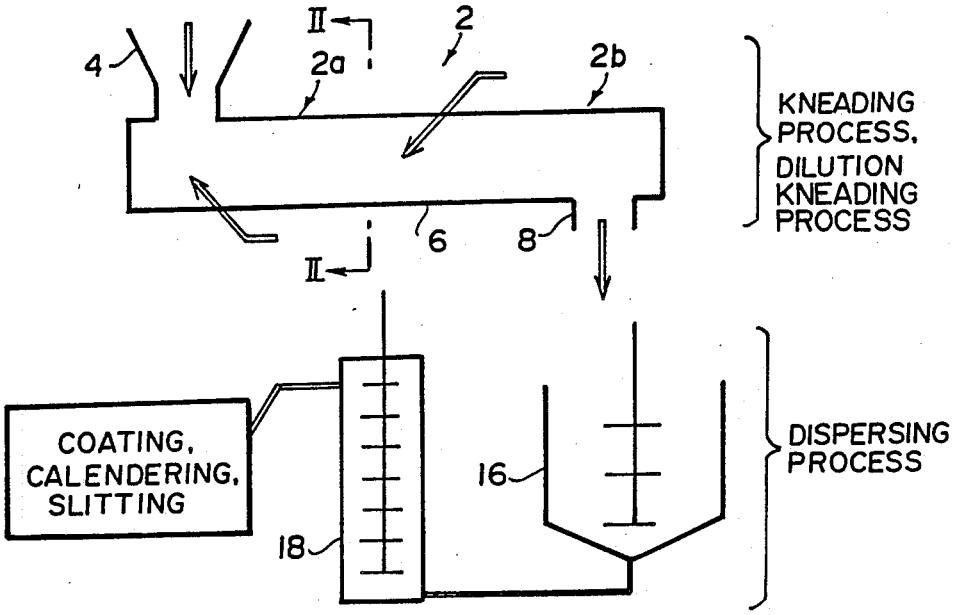
FIG. 1 is a flow diagram showing processes wherein an embodiment of the first method for preparing a magnetic coating composition in accordance with the present invention is employed.

FIG. 1 shows processes wherein an embodiment of the first method for preparing a magnetic coating composition in accordance with the present invention is employed.

Processes for manufacturing a magnetic coating composition comprise a process for carrying out normal kneading of magnetic grains and a solution which contains a binder in an organic solvent; a process for carrying out dilution kneading of the kneaded mixture, which results from the normal kneading process, and an organic solvent; and a process for dispersing the diluted mixture, which results from the dilution kneading process. A magnetic coating composition prepared in this manner is then applied to substrates. A substrate on which a layer of the magnetic coating composition has been overlaid is calendered, and thereafter slit into magnetic recording media.

In this embodiment, a single two-shaft continuous kneading and mixing machine 2 is used to carry out both the normal kneading process and the dilution kneading process. The normal kneading process is carried out in a normal kneading region 2*a* of a mixing chamber 6, and the dilution kneading process is carried out in a dilution kneading region 2*b* of the mixing chamber 6.

Specifically, magnetic grains, a binder, and carbon black are fed through an inlet 4 into the mixing chamber 6 of the two-shaft continuous kneading and mixing machine 2. A solution, which contains a binder in an organic solvent, is introduced into the mixing chamber 6 through an addition port (not shown), which is located in the vicinity of the inlet 4. The resulting mixture is kneaded in the normal kneading region 2*a* of the mixing chamber 6. Also, an organic solvent and a solution, which contains a binder in an organic solvent, are introduced as diluents through an addition port (not shown), which is spaced a predetermined distance apart from the inlet 4, into the mixing chamber 6. The kneaded mixture, which results from the normal kneading process, is subjected to dilution kneading (i.e. the dilution of the mixture while it is being kneaded) with the diluents in the dilution kneading region 2*b* of the mixing chamber 6. The diluted mixture which results from the dilution kneading process is discharged through an outlet 8. The mixing chamber 6 has the shape of a cylinder whose long axis runs from side to side. The inlet 4 is located in the vicinity of the edge of one side of the mixing chamber 6, and the outlet 8 is located in the vicinity of the edge of the other side of the mixing chamber 6. The path length of the mixing chamber 6 should fall within the range of 0.5 m to 5 m, and preferably within the range of 0.6 m to 4 m.

Figure 2:
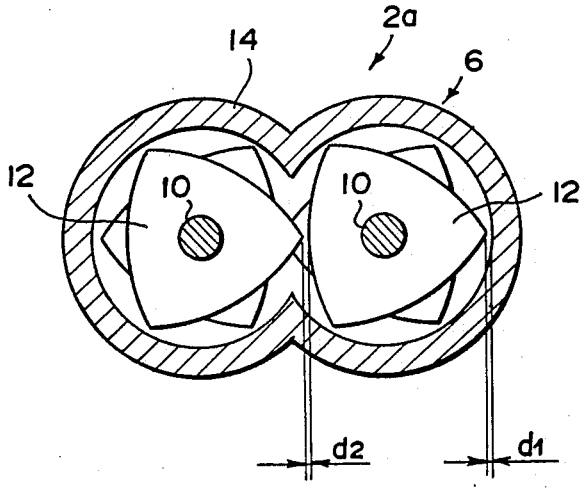
FIG. 2 is a cross-sectional view taken along line II—II of FIG. 1 and showing the normal kneading region of a two-shaft continuous kneading and mixing machine.

FIG. 2 shows a cross-section of the norma kneading region 2*a* of the mixing chamber 6. As illustrated, the mixing chamber 6 comprises a pair of shafts 10, 10 which are spaced a predetermined distance apart from each other and which extend in parallel, a plurality of paddles 12, 12, . . . which serve as blade members and which are secured to each of the shafts 10, 10 at specific intervals along the axis of the shaft, and a barrel 14 in which the paddles 12, 12, . . . are accommodated. The paddles 12, 12, . . . have a pseudo-triangular shape and are equal in size to each other. The paddles 12, 12, . . . are secured to each shaft so that each paddle 12 differs in phase by an angle of 60° from the adjacent paddles 12, 12, . . . . Also, the phase of each paddle 12 secured to one of the shafts 10, 10 is equal to the phase of the paddle 12 which is secured to the other shaft 10 and which faces said paddle 12 secured to said one shaft 10. The barrel 14 has a cocoon-like cross-sectional shape, and a gap d1 of a predetermined width exists between the inner surface of the barrel 14 and a tip of each paddle 12. The dimensions of the pseudo-triangular paddles 12, 12, . . . are set so that a gap d2 of a predetermined width exists between each paddle 12 secured to one of the shafts 10, 10 and the paddle 12 which is secured to the other shaft 10 and which faces said paddle 12 secured to said one shaft 10. The widths of the gap d1 and the gap d2 may be identical or different. In this embodiment, the widths of the gap d1 and the gap d2 are set so that $$0.5\ \text{mm} \leqq d1 \leqq 4\ \text{mm},\ 0.5\ \text{mm} \leqq d2 \leqq 4\ \text{mm}.$$

Also, the paddle diameter D of each paddle 12 (i.e. the diameter of the circular path along which a tip of each paddle 12 rotates) is set so that $$50\ \text{mm} \leqq D \leqq 400\ \text{mm}.$$

The paddles 12, 12, . . . should rotate at a speed falling within the range of 5 to 200 rpm, and preferably within the range of 20 to 120 rpm. The circumferential speed of the paddles 12, 12, . . . should fall within the range of 1 cm/sec to 50 cm/sec, and preferably within the range of 2 cm/sec to 20 cm/sec.

As defined above, the widths of the gap d1 and the gap d2 should not be smaller than 0.5 mm. This is because an excessive loads should not be placed on the paddles 12, 12, . . . and the shafts 10, 10, and because the specified width is appropriate from the viewpoint of the mechanical accuracy. Also, the widths of the gap d1 and the gap d2 should not be larger than 4 mm. This is because normal kneading should be carried out under a substantially high shearing force, thereby to increase the packing density of the magnetic grains in the magnetic coating composition.

The dilution kneading region 2*b* of the mixing chamber 6 has approximately the same cross-sectional shape as the normal kneading region 2*a*, except for the widths of the gap d1′ and the gap d2′ respectively corresponding to the gap d1 and the gap d2 in the normal kneading region 2*a* shown in FIG. 2. Specifically, the widths of the gap d1′ and the gap d2′ in the dilution kneading region 2*b* are set so that $$0.5d1 \leqq d1' \leqq 0.8d1,\ 0.5d2'23\ d2' \leqq 0.8d2.$$

As defined above, the widths of the gap d1′0 and the gap d2′ in the dilution kneading region 2*b* are set so that they fall respectively within the range of 50% to 80% of the widths of the gap d1 and the gap d2. This is because a substantially high shearing force should be given to the mixture which is subjected to dilution kneading and which has a viscosity lower than the viscosity of the mixture kneaded in the normal kneading region 2*a*. Another reason for the above is that the short pass phenomenon should be prevented from occurring during the dilution kneading process. The range of 50% to 80% takes into account the extent to which the viscosity of the mixture subjected to the normal kneading process and the viscosity of the mixture subjected to the dilution kneading process differ.

The number of the paddles 12, 12, . . . in the normal kneading region 2*a* should preferably not be smaller than 20, and the number of the paddles 12, 12, . . . in the dilution kneading region 2*b* should also preferably not be smaller than 20. The ratio of the number of the paddles 12, 12, . . . in the normal kneading region 2*a* to the number of the paddles 12, 12, . . . in the dilution kneading region 2*b* should preferably fall within the range of 6:4 to 3:7.

Instead of the paddles 12, 12, . . . being used, shallow flight screws or the like may be used as the blade members.

As shown in FIG. 1, the dispersion process is carried out with a dissolver 16 and a sand grinder 18 which are connected in series. The diluted mixture resulting from the dilution kneading process is quickly stirred in the dissolver 16, and thereafter subjected to fine dispersion in the sand grinder 18.

Effects of this embodiment will be described hereinbelow.

As shown in FIG. 1, the normal kneading process is carried out in the normal kneading region 2*a* of the mixing chamber 6 of the two-shaft continuous kneading and mixing machine 2. In the normal kneading region 2*a*, the widths of the gap d2 between each pair of the paddles 12, 12 facing each other and the gap d1 between the tip of each paddle 12 and the inner surface of the barrel 14 are set to values falling within the range of 0.5 mm to 4 mm. Therefore, the magnetic grains, the binder, carbon black, and the solution which contains a binder in an organic solvent can be smoothly kneaded under a high shearing force in the gap d1 and the gap d2 without any excessive loads being applied to the paddles 12, 12, . . . and the shafts 10, 10. Accordingly, a kneaded mixture having a high viscosity can be obtained from the normal kneading process.

The dilution kneading process is carried out in the dilution kneading region 2*b* of the mixing chamber 6 of the two-shaft continuous kneading and mixing machine 2. In the dilution kneading region 2*b*, the widths of the gap d2′ between each pair of the paddles 12, 12 facing each other and the gap d1′ between the tip of each paddle 12 and the inner surface of the barrel 14 are respectively set to values falling within the range of 50% to b 80% of the widths of the gap d2 and the gap d1 in the normal kneading region 2*a*. Therefore, even though the viscosity of the mixture subjected to dilution kneading is decreased because an organic solvent or the like is added thereto, the mixture can be diluted under a high shearing force. Also, the short pass phenomenon can be efficiently prevented from occurring during the dilution kneading process. Accordingly, a uniformly diluted mixture can be obtained from the dilution kneading process.

The uniformly diluted mixture is fed to the dispersion process. Therefore, the diluted mixture can be dispersed quickly and to a large extent. When a magnetic coating composition prepared in this manner is applied to a substrate, and the substrate on which a layer of the magnetic coating composition has been overlaid is subjected through processes such as drying, orientation, calendering, and slitting, it is possible to obtain magnetic recording media in which the packing density of the magnetic grains is high and the dispersing quality of the magnetic grains is good, and which exhibit excellent magnetic characteristics, electromagnetic characteristics, or the like.

Additionally, it was revealed that good results could be obtained when the solids concentration in the mixture subjected to the normal kneading process fell within the range of 65 to 95 wt%, and the solids concentration in the mixture subjected to the dilution kneading process fell within the range of 30 to 60 wt%.

An embodiment of the second method for preparing a magnetic coating composition in accordance with the present invention will be described hereinbelow with reference to FIGS. 5 and 6.

Figure 5:
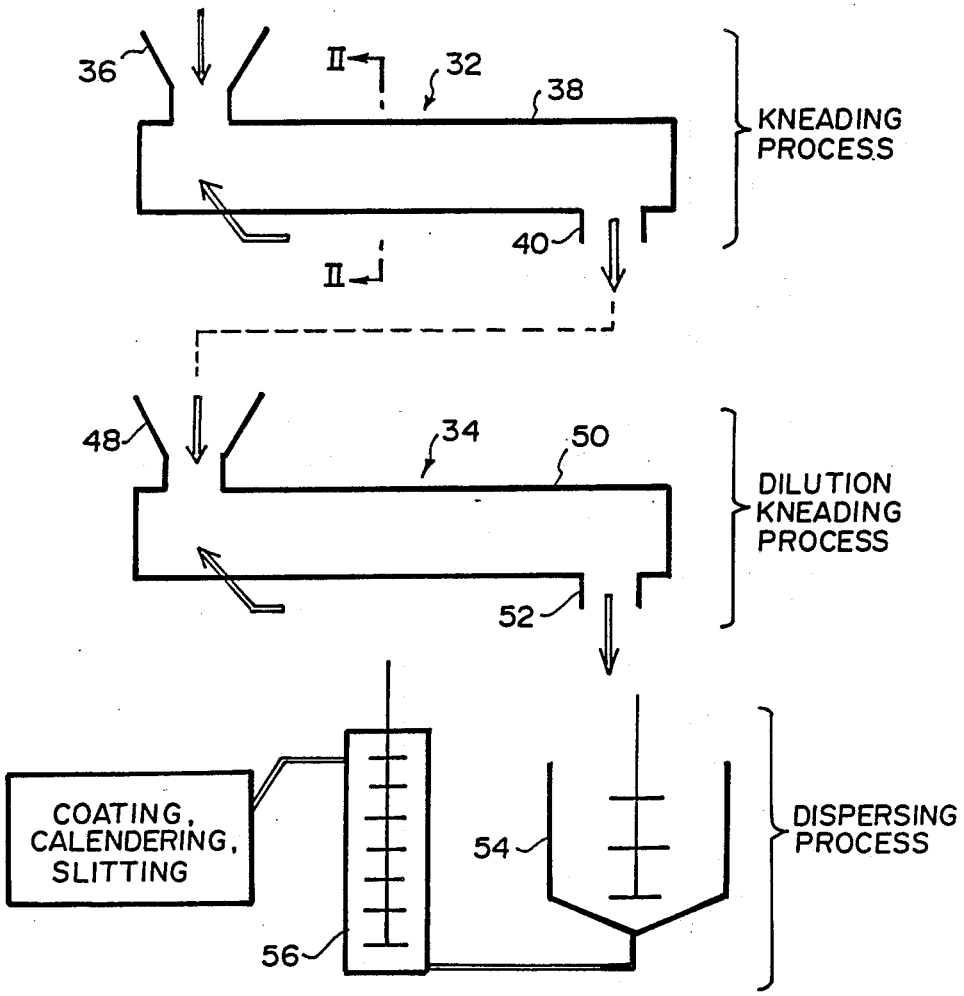
FIG. 5 is a flow diagram showing processes wherein an embodiment of the second method for preparing a magnetic coating composition in accordance with the present invention is employed.

With reference to FIG. 5, two two-shaft continuous kneading and mixing machines are used to carry out respectively the normal kneading process and the dilution kneading process. The normal kneading process is carried out in a first two-shaft continuous kneading and mixing machine 32, and the dilution kneading process is carried out in a second two-shaft continuous kneading and mixing machine 34.

Specifically, magnetic grains, a binder, and carbon black are fed through an inlet 36 into a mixing chamber 38 of the first two-shaft continuous kneading and mixing machine 32. A solution, which contains a binder in an organic solvent, is introduced through an addition port (not shown), which is located in the vicinity of the inlet 36, into the mixing chamber 38. The resulting mixture is kneaded in the the mixing chamber 38, and the kneaded mixture thus obtained is discharged through an 5 outlet 40 from the first two-shaft continuous kneading and mixing machine 32. The mixing chamber 38 has the shape of a cylinder whose long axis runs from side to side. The inlet 36 is located in the vicinity of the edge of one side of the mixing chamber 38, and the outlet 40 is located in the vicinity of the edge of the other side of the mixing chamber 38. The path length of the mixing chamber 38 should fall within the range of 0.5 m to 5 m, and preferably within the range of 0.6 m to 4 m.

Figure 6:
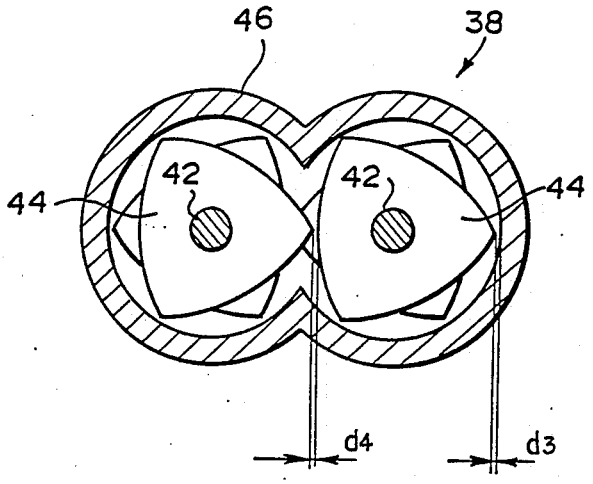
FIG. 6 is a cross-sectional view taken along line II—II of FIG. 5 and showing a first two-shaft continuous kneading and mixing machine which carries out a normal kneading process.

FIG. 6 shows the cross-section of the mixing chamber 38. As illustrated, the mixing chamber 38 comprises a pair of shafts 42, 42 which are spaced a predetermined distance apart from each other and which extend in parallel, a plurality of paddles 44, 44, ... which serve as blade members and which are secured to each of the shafts 42, 42 at intervals along the axis of the shaft, and a barrel 46 in which the paddles 44, 44, . . . secured to the shafts 42, 42 are accommodated. The paddles 44, 44, . . . have a pseudo-triangular shape and are equal in size to each other. The paddles 44, 44, . . . are secured to each shaft so that each paddle 44 differs in phase by an angle of 60° from the adjacent paddle 44. Also, the phase of each paddle 44 secured to one of the shafts 42, 42 is equal to the phase of the paddle 44 which is secured to the other shaft 42 and which faces said paddle 44 secured to said one shaft 42. The barrel 46 has a cocoon-like cross-sectional shape so that a gap d3 having a predetermined width will exist between the inner surface of the barrel 46 and a tip of each paddle 44. The dimensions of the pseudo-triangular paddles 44, 44, . . . are set so that a gap d4 having a predetermined width will exist between each paddle 44 secured to one of the shafts 42, 42 and the paddle 44 which is secured to the other shaft 42 and which faces said paddle 44 secured to said one shaft 42. The widths of the gap d3 and the gap d4 may be identical or different. In this embodiment, the widths of the gap d3 and the gap d4 are set so that $$0.5\ \text{mm} \leqq d3 \leqq 4\ \text{mm},\ 0.5\ \text{mm} \leqq d4 \leqq 4\ \text{mm}.$$

Also, the paddle diameter D of each paddle 44 (i.e. the diameter of the circular path along which a tip of each paddle 44 rotates) is set so that $$50\ \text{mm} \leqq D \leqq 400\ ,,.$$

The paddles 44, 44, . . . should rotate at a speed falling within the range of 5 to 200 rpm, and preferably within the range of 20 to 120 rpm. The circumferential speed of the paddles 44, 44, . . . should fall within the range of 1 cm/sec to 50 cm/sec, and preferably within the range of 2 cm/sec to 20 cm/sec.

As defined above, the widths of the gap d3 and the gap d4 are made not smaller than 0.5 mm. This is because excessive loads should not be placed on the paddles 44, 44, . . . and the shafts 42, 42, and because the specified width is appropriate from the viewpoint of the mechanical accuracy. (Specifically, if the widths of the gap d3 and the gap d4 are made smaller than 0.5 mm, the paddles 44, 44, . . . will interfere with the inner surface of the barrel 46 because mechanical run-out will occur when they rotate during the normal kneading process. Also, the shearing force given to the mixture subjected to the normal kneading process will become excessively large, and therefore a very powerful motor will have to be used to rotate the shafts 42, 42.) Also, the widths of the gap d3 and the gap d4 are made smaller than 4 mm. This is because normal kneading should be carried out under a substantially high shearing force, thereby to increase the packing density of the magnetic grains in the magnetic coating composition. (Specifically, if the widths of the gap d3 and the gap d4 are made larger than 4 mm, a substantially high shearing force will not be given to the mixture subjected to the normal kneading process, and the mixture will not be kneaded well. Therefore, the packing density of the magnetic grains in the magnetic coating composition cannot be increased, and a magnetic recording medium having a high power output cannot be obtained when the magnetic coating composition is used to form a magnetic layer of the magnetic recording medium.) The widths of the gap d3 and the gap d4 should preferably fall within the range of 0.6 mm to 3 mm.

The paddle diameter D of each paddle 44 is made to fall within the range of 50 mm to 400 mm. This is because the mixture subjected to the normal kneading process has a high viscosity and should be kneaded under a high force. Specifically, if the paddle diameter D is made smaller than 50 mm, the diameters of the shafts 42, 42 must be kept small, and the mechanical strength of the first two-shaft continuous kneading and mixing machine 32 cannot be kept high. If the paddle diameter D is made larger than 400 mm, it becomes necessary to use a very powerful motor in order to rotate the paddles 44, 44, . . .

Instead of the paddles 44, 44, . . . being used, shallow flight screws or the like may be used as the blade members.

As shown in FIG. 5, the kneaded mixture which has been discharged from the outlet 40 of the first two-shaft continuous kneading and mixing machine 32 is introduced through an inlet 48 into a mixing chamber 50 of the second two-shaft continuous kneading and mixing machine 34. Also, an organic solvent and a solution, which contains a binder in an organic solvent, are introduced as diluents through an addition port (not show), which is located in the vicinity of the inlet 48, into the mixing chamber 50. The kneaded mixture is subjected to dilution kneading (i.e. the mixture is diluted while it is being kneaded) with the diluents in the mixing chamber 50. The diluted mixture which results from the dilution kneading process is discharged through an outlet 52 from the second two-shaft continuous kneading and mixing machine 34.

The second two-shaft continuous kneading and mixing machine 34 has approximately the same configuration as the first two-shaft continuous kneading and mixing machine 32, except for the widths of the gap d3′ and the gap d4′ respectively corresponding to the gap d3 and the gap d4 in the first two-shaft continuous kneading and mixing machine 32 shown in FIG. 6. Specifically, the widths of the gap d3′ and the gap d4′ in the second two-shaft continuous kneading and mixing machine 34 are set so that $$0.5d3 \leqq d3' \leqq 0.8d33,\ 0.5d4 \leqq d4' \leqq 0.8d4.$$

As defined above, the widths of the gap d3′ and the gap d4′ in the second two-shaft continuous kneading and mixing machine 34 are set so that they fall respectively within the range of 50% to 80% of the width of the gap d3 and within the range of 50% to 80% of the width of the gap d4 in the first two-shaft continuous kneading and mixing machine 32. This is because a substantially high shearing force should be given to the mixture as it is subjected to the dilution kneading, and the mixture being diluted has a lower viscosity than that of the mixture which was kneaded in the first two-shaft continuous kneading and mixing machine 32. Another reason for the above is that the short pass phenomenon should be prevented from occurring during the dilution kneading process. The range of 50% to 80% takes into account the extent to which the viscosity of the mixture subjected to the normal kneading process and the viscosity of the mixture subjected to the dilution kneading process differ. For example, if the widths of the gap d3′ and the gap d4′ in the second two-shaft continuous kneading and mixing machine 34 are made respectively smaller than 50% of the gap d3 and 50% of the gap d4, an excessively large shearing force is given to the mixture subjected to the dilution kneading process, and the magnetic grains which are acicular and which are contained in the mixture break. Therefore, if such a magnetic coating composition, which was prepared from the diluted mixture resulting from the dilution kneading process, is used to form a magnetic layer of a magnetic recording medium, a magnetic recording medium exhibiting low anti-transfer characteristics and low orientation characteristics is obtained. If the anti-transfer characteristics are low, transfer problems occur easily when the magnetic recording medium is wound in a form of a roll. Low orientation characteristics result in low residual magnetic flux density (Br) and a low power output.

As shown in FIG. 5, the dispersion process is carried out with a dissolver 54 and a sand grinder 56 which are connected in series. The diluted mixture resulting from the dilution kneading process is quickly stirred in the dissolver 54, and thereafter subjected to fine dispersion in the sand grinder 56.

Effects of the embodiment shown in FIG. 5 will be described hereinbelow.

As shown in FIG. 5, the normal kneading process is carried out in the mixing chamber 38 of the first two-shaft continuous kneading and mixing machine 32. In the mixing chamber 38, the widths of the gap d4 between each pair of the paddles 44, 44 facing each other and the gap d3 between the tip of each paddle 44 and the inner surface of the barrel 46 are set to values falling within the range of 0.5 mm to 4 mm. Therefore, the magnetic grains, the binder, carbon black, and the solution which contains a binder in an organic solvent can be smoothly kneaded under a high shearing force in the gap d33 and the gap d4 without any excessive loads being placed on the paddles 44, 44, . . . and the shafts 42, 42. Accordingly, a kneaded mixture having a high viscosity can be obtained from the normal kneading process.

The dilution kneading process is carried out in the mixing chamber 50 of the second two-shaft continuous kneading and mixing machine 34. In the mixing chamber 50, the widths of the gap d4' between each pair of paddles 44, 44 facing each other and the gap d3' between the tip of each paddle 44 and the inner surface of the barrel 46 are respectively set to values falling within the range of 50% to 80% of the width of the gap d4 and the width of the gap d3 in the first two-shaft continuous kneading and mixing machine 32. Therefore, even though the viscosity of the mixture being subjected to dilution kneading is decreased because an organic solvent or the like is added thereto, the mixture can be diluted under a high shearing force. Also, the short pass phenomenon can be efficiently prevented from occurring during the dilution kneading process. Accordingly, a uniformly diluted mixture can be obtained from the dilution kneading process.

The uniformly diluted mixture is fed to the dispersion process. Therefore, the diluted mixture can be dispersed quickly and to a large extent. When a magnetic coating composition prepared in this manner is applied to a substrate, and a substrate with a layer of the magnetic coating composition overlaid thereon is subjected to processes such as drying, orientation, calendering, and slitting, it is possible to obtain magnetic recording media in which the packing density of the magnetic grains is high and the dispersing quality of the magnetic grains is good, and which exhibit excellent magnetic characteristics, electromagnetic characteristics, or the like.

The first method for preparing a magnetic coating composition in accordance with the present invention will further be illustrated by the following nonlimitative examples. In the examples, the term "parts" means parts by weight unless otherwise specified.

EXAMPLE 1

A binder resin solution Y1 having a resin concentration of 20% was prepared from the constituents listed below.

Binder resin solution Y1:

| | |
|---|---|
| Hydroxyl group-containing vinyl chloride - vinyl acetate copolymer (Denka Vinyl 1000G, Denki Kagaku Kogyo K.K.) | 20 parts |
| Methyl ethyl ketone | 40 parts |
| Butyl acetate | 40 parts |

A binder resin solution Y2 having a resin concentration of 15% was prepared from the constituents listed below.

Binder resin solution Y2:

| | |
|---|---|
| Polyurethane resin solution (Crisvon 7209, concentration 45%, Dainippon Ink and Chemicals, Inc.) | 30 parts |
| Methyl ethyl ketone | 30 parts |
| Butyl acetate | 30 parts |

Normal kneading process:

In the normal kneading process, the constituents listed below were used.

| | |
|---|---|
| Co—$FeO_x$ (x = 1.48, specific surface area: 35 $m^2/g$, mean length of longer axis: 0.3μ, coercive force: 700 Oe,) | 100 parts |
| Hydroxyl group-containing vinyl chloride - vinyl acetate copolymer (Denka Vinyl 1000G, Denki Kagaku Kogyo K.K.) | 9.5 parts |
| Carbon black | 1 part |
| Binder resin solution Y1 | 32.5 parts |

The constituents listed above were continuously introduced into a normal kneading region of a mixing chamber of a two-shaft continuous kneading and mixing machine, and continuously kneaded therein until a kneaded mixture was obtained. In the normal kneading region, the width of the gap between each pair of paddles, which were secured to different shafts and which faced each other, and the width of the gap between each paddle and the inner surface of the barrel were 1 mm. The diameter of each paddle was 100 mm; the speed at which the paddles were rotated fell within the range of 30 to 120 rpm; and the circumferential speed of the paddles fell within the range of 5 cm/sec to 20 cm/sec. The path length of the normal kneading region of the mixing chamber was 1 m. Dilution kneading process:

Thereafter, in a dilution kneading process, the specified amounts of the constituents listed below were added per 143 parts of the kneaded mixture obtained from the normal kneading process.

| | |
|---|---|
| Binder resin solution Y2 | 26.7 parts |
| Methyl ethyl ketone | 25 parts |
| Butyl acetate | 25.3 parts |

The constituents listed above were continuously introduced into a dilution kneading region of the mixing chamber of the aforesaid two-shaft continuous kneading and mixing machine which was being used to carry out the normal kneading process, and continuously subjected to the dilution kneading process therein until a diluted mixture was obtained. In the dilution kneading region, the diameter of each paddle was larger by 0.2 mm than the diameter of each paddle located in the normal kneading region, so that the width of the gap between each pair of paddles, which were secured to different shafts and which faced each other, was 0.8 mm. Also, the inner diameter of the part of the barrel corresponding to the dilution kneading region was smaller by 0.1 mm than the inner diameter of the part of the barrel corresponding to the normal kneading region, so that the width of the gap between each paddle and the inner surface of the barrel was 0.8 mm. The path length of the dilution kneading region of the mixing chamber was 1 m.

Dispersion process:

Thereafter, in a dispersion process, the specified amounts of the constituents listed below were used per 220 parts of the diluted mixture obtained from the dilution kneading process.

| | |
|---|---|
| Myristic acid | 2.0 parts |
| Oleic acid | 0.5 part |
| Dimethyl polysiloxane | 0.2 part |
| $\alpha$-$Al_2O_3$ (mean grain diameter: 0.3$\mu$) | 1.0 part |
| Methyl ethyl ketone | 35.5 parts |
| Butyl acetate | 36 parts |

The diluted mixture and the constituents listed above were mixed and quickly stirred for one hour in a dissolver. Thereafter, the dispersion mixture obtained from the dissolver was subjected to fine dispersion processing by being sequentially introduced into six sand grinders which were connected to one another.

Each of the dispersion mixtures obtained from the dissolver and the six sand grinders was applied to a substrate, and subjected to orientation processing and drying in order to form a magnetic layer of a magnetic recording medium.

Figure 3:
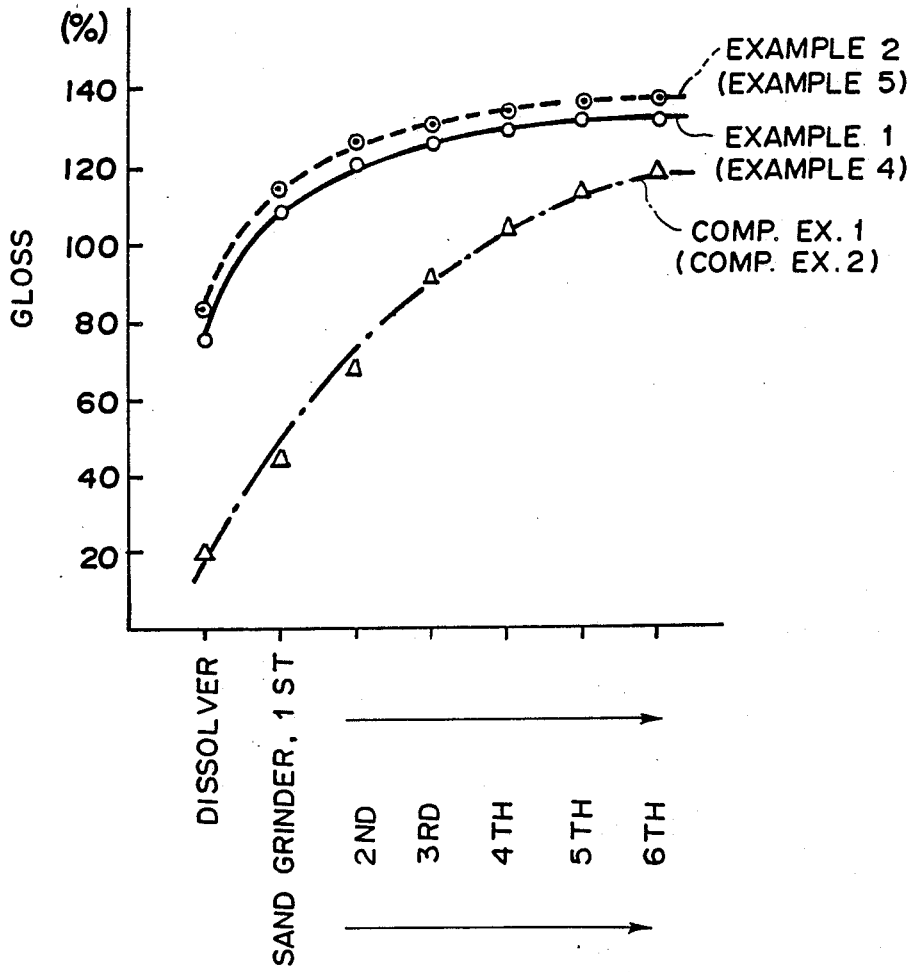
FIG. 3 is a graph showing the relationship between the surface gloss values (vertical axis) of magnetic layers constituted of dispersion mixtures which were discharged from various dispersing machines (horizontal axis), which relationship was found for examples prepared according to the first method of the present invention.
Figure 4:
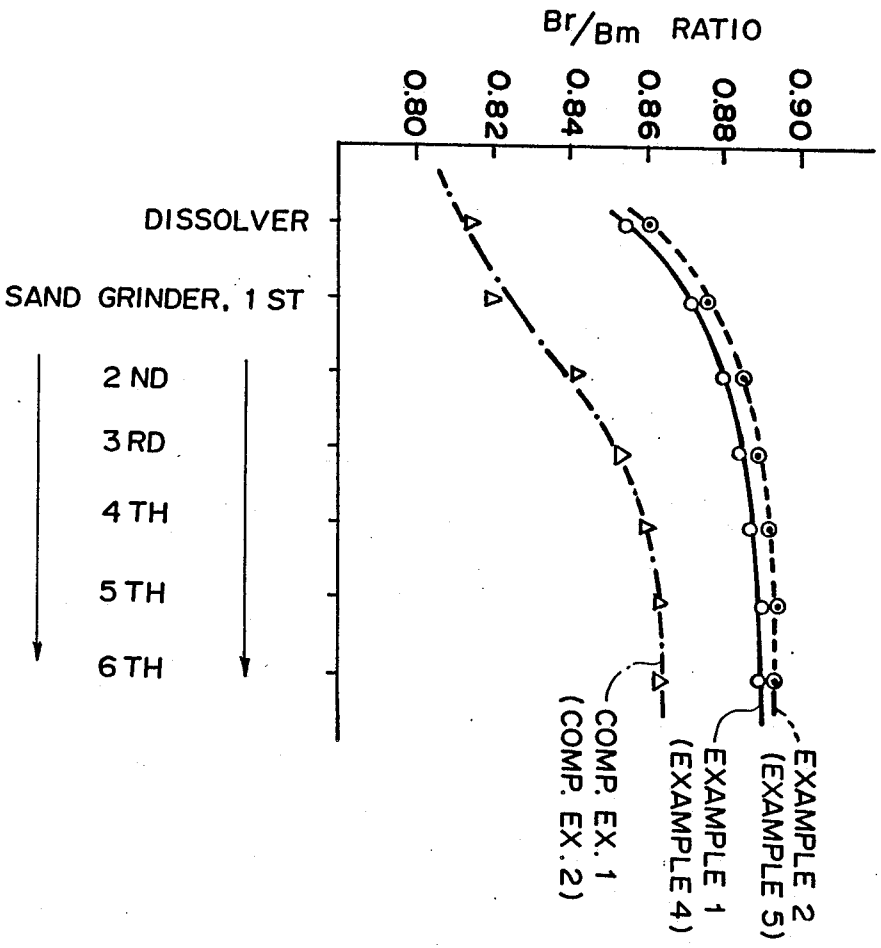
FIG. 4 is a graph showing the relationship between the Br/Bm ratios (vertical axis) of magnetic layers constituted of the dispersion mixtures discharged from various dispersing machines (horizontal axis), which relationship was found for examples prepared according to the first method of the present invention.

FIG. 3 shows the surface gloss values of the magnetic layers of the magnetic recording media thus obtained, and FIG. 4 shows the Br/Bm ratios of the magnetic layers. The Br/Bm ratio represents the degree of orientation of the magnetic grains in each of the magnetic layers, and was used herein in order to evaluate the dispersing quality of the magnetic grains. The surface gloss values were measured at an angle of light incidence of 60°. The surface gloss values shown in FIG. 3 are the values with respect to the specular gloss of a surface of a glass having a refractive index of 1.567, which specular gloss is taken as 100%. A digital gloss meter supplied by Suga Shikenki K. K. was used to measure the surface gloss value.

After fine dispersion processing with the six sand grinders was finished, the dispersion mixture thus 5 obtained was filtered through a filter having a mean pore diameter of 1.0 $\mu$m in order to prepare a magnetic coating composition. Thereafter, the magnetic coating composition was applied to the surface of a 14 $\mu$m-thick polyethylene terephthalate substrate at a rate such that the thickness of the magnetic layer was 4.0 $\mu$m after it was dried. The reverse-roll coating method was used for this purpose. While the layer of the magnetic coating composition was wet, it was subjected to orientation processing. Thereafter, the substrate with the layer of magnetic coating composition overlaid on it was dried and subjected to a supercalendering process in order to obtain a magnetic tape web. As for the magnetic tape web thus obtained, the coercive force (Hc, unit: oersted), the maximum magnetic flux density (Bm, unit: gauss), and the residual magnetic flux density (Br, unit: gauss) were measured with a vibrating sample magnetic flux meter (supplied by Toei Kogyo K. K.) at a magnetic field intensity (Hm) of 3 kOe. Table 1 shows the results of the measurements.

EXAMPLE 2

A magnetic tape web was made in the same manner as in Example 1, except that, in the dilution kneading region of the mixing chamber of the two-shaft continuous kneading and mixing machine, the width of the gap between each pair of paddles, which were secured to different shafts and which faced each other, and the width of the gap between each paddle and the inner surface of the barrel were respectively 0.6 mm.

COMPARATIVE EXAMPLE 1

A magnetic tape web was made in the same manner as in Example 1, except that, in the dilution kneading region of the mixing chamber of the two-shaft continuous kneading and mixing machine, the width of the gap between each pair of paddles, which were secured to different shafts and which faced each other, and the width of the gap between each paddle and the inner surface of the barrel were respectively 1 mm (i.e. were the same as the widths of such gaps in the normal kneading region).

TABLE 1

| | Magnetic Characteristics of Magnetic Tape Web | | | |
|---|---|---|---|---|
| | Bm (G) | Br (G) | Br/Bm | Hc (Oe) |
| Ex. 1 | 2190 | 1940 | 0.886 | 648 |
| Ex. 2 | 2210 | 1970 | 0.891 | 650 |
| Comp. Ex. 1 | 2100 | 1780 | 0.848 | 644 |

EXAMPLE 3

Samples of magnetic tape webs were made in the same manner as in Example 1, except that the normal kneading process and the dilution kneading process were respectively carried out in the normal kneading region and the dilution kneading region of each of two-shaft continuous kneading and mixing machines which had the configurations shown in Table 2, and the resin concentrations in the binder resin solutions Y1 and Y2 were changed, which in turn changed the solids concentrations in the mixtures subjected to the normal kneading process and the dilution kneading process as listed in Table 2. The results of measurements carried out on the samples are shown at the right part of Table 2.

TABLE 2

| Ex. 3 | Normal Kneading Process Paddle Diameter (mm) | Gap* (mm) | Solids Conc. (wt %) | Dilution Kneading Process Paddle Diameter (mm) | Gap** (mm) | Solids Conc. (wt %) | Gap Ratio*** (%) | Magnetic Characteristics of Magnetic tape web Bm (G) | Br (G) | Br/Bm | Hc (Oe) |
|---|---|---|---|---|---|---|---|---|---|---|---|
| Sample No. | | | | | | | | | | | |
| 1 | 50 | 1.5 | 80 | 50 | 1.2 | 40 | 80 | 2140 | 1880 | 0.878 | 650 |
| 2 | 200 | 1.5 | 80 | 200 | 0.9 | 40 | 60 | 2210 | 1970 | 0.891 | 646 |
| 3 | 100 | 0.5 | 80 | 100 | 0.4 | 40 | 80 | 2240 | 1980 | 0.884 | 645 |
| 4 | 100 | 3 | 80 | 100 | 2.1 | 40 | 70 | 2150 | 1910 | 0.888 | 648 |
| 5 | 100 | 1.0 | 80 | 100 | 0.5 | 40 | 50 | 2210 | 1970 | 0.891 | 646 |
| 6 | 100 | 1.0 | 80 | 100 | 0.8 | 40 | 80 | 2150 | 1910 | 0.888 | 648 |
| 7 | 100 | 1.0 | 65 | 100 | 0.5 | 30 | 50 | 2070 | 1850 | 0.894 | 650 |
| 8 | 100 | 1.0 | 65 | 100 | 0.5 | 60 | 50 | 2110 | 1840 | 0.872 | 650 |
| 9 | 100 | 1.0 | 95 | 100 | 0.5 | 30 | 50 | 2300 | 2020 | 0.878 | 642 |
| 10 | 100 | 1.0 | 95 | 100 | 0.5 | 60 | 50 | 2280 | 2010 | 0.882 | 642 |
| 11 | 100 | 1.0 | 50 | 100 | 0.5 | 40 | 50 | 1920 | 1700 | 0.885 | 648 |
| 12 | 100 | 1.0 | 80 | 100 | 0.5 | 20 | 50 | 2080 | 1770 | 0.851 | 643 |
| 13 | 100 | 1.0 | 80 | 100 | 0.5 | 70 | 50 | 2100 | 1780 | 0.848 | 642 |

*This mark indicates the gap d2 between paddles which face each other and the gap d1 between a paddle and the barrel in the normal kneading region. In this example, d2 = d1.
**This mark indicates the gap d2' between paddles which face each other and the gap d1' between a paddle and the barrel in the dilution kneading region. In this example, d2' = d1'.
***This mark indicates the d2'/d2 ratio or the d1'/d1 ratio.

The magnetic coating compositions obtained from the first step of the dispersion process, as well as from the subsequent steps of the dispersion process, in Example 1 and Example 2 in accordance with the present invention exhibited high surface gloss values and high Br/Bm ratios. The magnetic coating compositions obtained from the fourth and subsequent sand grinders in Example 1 and Example 2 exhibited approximately the same characteristics. Therefore, it was revealed that the dispersing efficiency was high in Example 1 and Example 2. On the other hand, in Comparative Example 1, a uniformly diluted mixture could not be obtained from the dilution kneading process. Therefore, the magnetic coating compositions obtained from the first step of the dispersion process in Comparative Example 1 exhibited a low surface gloss value and a low Br/Bm ratio. In Comparative Example 1, even after the dispersing operation was repeated with six sand grinders, a magnetic coating composition exhibiting characteristics as good as those of the magnetic coating compositions obtained in Example 1 and Example 2 could not be obtained. As for the magnetic characteristics of the magnetic tape webs, the magnetic tape webs obtained in Example 1 and Example 2 exhibited a maximum magnetic flux density (Bm), a residual magnetic flux density (Br), and a Br/Bm ratio which were higher than those of the magnetic tape web obtained in Comparative Example 1. This would be because, in Example 1 and Example 2, a high shearing force was given to the mixture during the dilution kneading process. As a result, the maximum magnetic flux density (Bm) increased, and good dispersing quality was obtained, so that the Br/Bm ratio became high and the residual magnetic flux density (Br) increased. Also, as will be clear from Table 2, the same effects could be obtained when the diameter of each paddle, the width of the gap between each pair of paddles and the width of the gap between each paddle and the inner surface of the barrel were changed in Example 3.

The second method for preparing a magnetic coating composition in accordance with the present invention will further be illustrated by the following nonlimitative examples. In the examples, the term "parts" means parts by weight unless otherwise specified.

EXAMPLE 4

A binder resin solution Y1 having a resin concentration of 20% was prepared from the constituents listed below.

Binder resin solution Y1:

| | |
|---|---|
| Hydroxyl group-containing vinyl chloride - vinyl acetate copolymer (Denka Vinyl 1000G, Denki Kagaku Kogyo K.K.) | 20 parts |
| Methyl ethyl ketone | 40 parts |
| Butyl acetate | 40 parts |

A binder resin solution Y2 having a resin concentration of 15% was prepared from the constituents listed below.

Binder resin solution Y2:

| | |
|---|---|
| Polyurethane resin solution (Crisvon 7209, concentration 45% Dainippon Ink and Chemicals, Inc. | 30 parts |
| Methyl ethyl ketone | 30 parts |
| Butyl acetate | 30 parts |

Normal kneading process:

In the normal kneading process, the constituents listed below were used.

| | |
|---|---|
| Co—$FeO_x$ (x = 1.48, specific surface area: 35 $m^2/g$, mean length of longer axis: 0.3μ, coercive force: 700 Oe,) | 100 parts |
| Hydroxyl group-containing vinyl chloride - vinyl acetate copolymer (Denka Vinyl 1000G, Denki Kagaku Kogyo K.K.) | 9.5 parts |
| Carbon black | 1 part |
| Binder resin solution Y1 | 32.5 parts |

The constituents listed above were continuously introduced into the mixing chamber of a two-shaft continuous kneading and mixing machine, and continuously kneaded therein to obtain a kneaded mixture. In the mixing chamber, the width of the gap between each pair of paddles, which were secured to different shafts and which faced each other, and the width of the gap between each paddle and the inner surface of the barrel were 1 mm. The diameter of each paddle was 100 mm, the speed at which the paddles were rotated fell within the range of 30 to 120 rpm, and the circumferential speed of the paddles fell within the range of 5 cm/sec to 20 cm/sec. The path length of the mixing chamber was 1 m.

Dilution kneading process:

Thereafter, in the dilution kneading process, the specified amounts of the constituents listed below were used per 143 parts of the kneaded mixture obtained from the normal kneading process.

| | |
|---|---|
| Binder resin solution Y2 | 26.7 parts |
| Methyl ethyl ketone | 25 parts |
| Butyl acetate | 25.3 parts |

The kneaded mixture and the constituents listed above were continuously introduced into the mixing chamber of a two-shaft continuous kneading and mixing machine, and continuously subjected to the dilution kneading process therein in order to obtain a diluted mixture. In the mixing chamber, the diameter of each paddle was larger by 0.2 mm than the diameter of each paddle located in the mixing chamber of the two-shaft continuous kneading and mixing machine which was used to carry out the normal kneading process, so that the width of the gap between each pair of paddles, which were secured to different shafts and which faced each other, was 0.8 mm. Also, the inner diameter of the barrel of the two-shaft continuous kneading and mixing machine used to carry out the dilution kneading process was smaller by 0.1 mm than the inner diameter of the barrel of the two-shaft continuous kneading and mixing machine which was used to carry out the normal kneading process, so that the width of the gap between each paddle and the inner surface of the barrel was 0.8 mm.

Dispersion process:

Thereafter, in the dispersion process, the specified amounts of the constituents listed below were used per 220 parts of the diluted mixture obtained from the dilution kneading process.

| | |
|---|---|
| Myristic acid | 2.0 parts |
| Oleic acid | 0.5 part |
| Dimethyl polysiloxane | 0.2 part |
| $\alpha$-$Al_2O_3$ (mean grain diameter: 0.3 ) | 1.0 part |
| Methyl ethyl ketone | 35.5 parts |
| Butyl acetate | 36 parts |

The diluted mixture and the constituents listed above were mixed and quickly stirred for one hour in a dissolver. Thereafter, the dispersion mixture obtained from the dissolver was subjected to fine dispersion processing by being sequentially introduced into six sand grinders which were connected to one another.

Each of the dispersion mixtures obtained from the dissolver and the six sand grinders was applied to a substrate, and subjected to orientation processing and drying in order to form a magnetic layer of a magnetic recording medium.

FIG. 3 shows the surface gloss values of the magnetic layers of the magnetic recording media thus obtained, and FIG. 4 shows the Br/Bm ratios of the magnetic layers. The surface gloss values were measured in the same manner as in Example 1.

After the fine dispersion processing with the six sand grinders was finished, the dispersion mixture thus obtained was filtered through a filter having a mean pore diameter of 1.0 μm in order to prepare a magnetic coating composition. Thereafter, the magnetic coating composition was applied to the surface of a 14 μm-thick polyethylene terephthalate substrate at a rate such that the thickness of the magnetic layer after it was dried was 4.0 μm. The reverse-roll coating method was used for this purpose. While the layer of the magnetic coating composition was wet, it was subjected to orientation processing. Thereafter, the substrate with the layer of the magnetic coating composition overlaid thereon was dried, and subjected to a supercalendering process in order to obtain a magnetic tape web. As for the magnetic tape web thus obtained, the coercive force (Hc, unit: oersted), the maximum magnetic flux density (Bm, unit: gauss), and the residual magnetic flux density (Br, unit: gauss) were measured with a vibrating sample magnetic flux meter (supplied by Toei Kogyo K. K.) at a magnetic field intensity (Hm) of 3 kOe. Table 3 shows the results of the measurements.

EXAMPLE 5

A magnetic tape web was made in the same manner as Example 4, except that the dilution kneading process was carried out with a two-shaft continuous kneading and mixing machine provided with a mixing chamber wherein the width of the gap between each pair of paddles, which were secured to different shafts and which faced each other, and the width of the gap between each paddle and the inner surface of the barrel were respectively 0.6 mm.

COMPARATIVE EXAMPLE 2

A magnetic tape web was made in the same manner as in Example 4, except that the dilution kneading process was carried out with a two-shaft continuous kneading and mixing machine provided with a mixing chamber wherein the width of the gap between each pair of paddles, which were secured to different shafts and which faced each other, and the width of the gap between each paddle and the inner surface of the barrel were respectively 1 mm (i.e. were the same as the widths of such gaps in the two-shaft continuous kneading and mixing machine which was used to carry out the normal kneading process).

TABLE 3

| | Magnetic Characteristics of Magnetic Tape Web | | | |
|---|---|---|---|---|
| | Bm (G) | Br (G) | Br/Bm | Hc (Oe) |
| Ex. 4 | 2190 | 1940 | 0.886 | 648 |
| Ex. 5 | 2210 | 1970 | 0.891 | 650 |
| Comp. Ex. 2 | 2100 | 1780 | 0.848 | 640 |

EXAMPLE 6

Samples of magnetic tape webs were made in the same manner as in Example 4, except that the normal kneading process and the dilution kneading process were carried out in two-shaft continuous kneading and mixing machines which had the configurations shown in Table 4, and the resin concentrations in the binder resin solutions Y1 and Y2 were changed, which in turn changed the solids concentrations in the mixtures subjected to the normal kneading process and the dilution kneading process as listed in Table 4. The results of the measurements carried out on the samples are shown at the right part of Table 4.

TABLE 4

| Ex. 6 | Normal Kneading Process Paddle Diameter (mm) | Gap* (mm) | Solids Conc. (wt %) | Dilution Kneading Process Paddle Diameter (mm) | Gap** (mm) | Solids Conc. (wt %) | Gap Ratio*** (%) | Magnetic Characteristics of Magnetic tape web Bm (G) | Br (G) | Br/Bm | Hc (Oe) |
|---|---|---|---|---|---|---|---|---|---|---|---|
| Sample No. | | | | | | | | | | | |
| 1 | 50 | 1.5 | 80 | 50 | 1.2 | 40 | 80 | 2150 | 1900 | 0.884 | 652 |
| 2 | 200 | 1.5 | 80 | 200 | 0.9 | 40 | 60 | 2230 | 1980 | 0.888 | 648 |
| 3 | 100 | 0.5 | 80 | 100 | 0.4 | 40 | 80 | 2260 | 1990 | 0.881 | 647 |
| 4 | 100 | 3 | 80 | 100 | 2.1 | 40 | 70 | 2160 | 1920 | 0.889 | 650 |
| 5 | 100 | 1.0 | 80 | 100 | 0.5 | 40 | 50 | 2220 | 1970 | 0.887 | 648 |
| 6 | 100 | 1.0 | 80 | 100 | 0.8 | 40 | 80 | 2170 | 1920 | 0.885 | 650 |
| 7 | 100 | 1.0 | 65 | 100 | 0.5 | 30 | 50 | 2090 | 1860 | 0.890 | 652 |
| 8 | 100 | 1.0 | 65 | 100 | 0.5 | 60 | 50 | 2100 | 1850 | 0.881 | 652 |
| 9 | 100 | 1.0 | 95 | 100 | 0.5 | 30 | 50 | 2300 | 2020 | 0.878 | 644 |
| 10 | 100 | 1.0 | 95 | 100 | 0.5 | 60 | 50 | 2290 | 2020 | 0.882 | 644 |
| 11 | 100 | 1.0 | 50 | 100 | 0.5 | 40 | 50 | 1940 | 1720 | 0.887 | 650 |
| 12 | 100 | 1.0 | 80 | 100 | 0.5 | 20 | 50 | 2090 | 1780 | 0.851 | 645 |
| 13 | 100 | 1.0 | 80 | 100 | 0.5 | 70 | 50 | 2110 | 1790 | 0.848 | 644 |

*This mark indicates the gap d4 between paddles which face each other and the gap d3 between a paddle and the barrel in the first two-shaft continuous kneading and mixing machine. In this example, d4 = d3.
**This mark indicates the gap d4' between paddles which face each other and the gap d3' between a paddle and the barrel in the second two-shaft continuous kneading and mixing machine. In this example, d4' = d3'.
***This mark means the d4'/d4 ratio or the d3'/d3 ratio.

The magnetic coating compositions obtained from the first step of the dispersion process, as well as from the subsequent steps of the dispersion process, in Example 4 and Example 5 exhibited high surface gloss values and high Br/Bm ratios. The magnetic coating compositions obtained from the fourth and subsequent sand grinders in Example 4 and Example 5 exhibited approximately the same characteristics. Therefore, it was revealed that the dispersing efficiency was high in Example 4 and Example 5. On the other hand, in Comparative Example 2, a uniformly diluted mixture could not be obtained from the dilution kneading process. Therefore, the magnetic coating compositions obtained from the first step of the dispersion process in Comparative Example 2 exhibited a low surface gloss value and a low Br/Bm ratio. In Comparative Example 2, even after the dispersing operation was repeated with six sand grinders, a magnetic coating composition exhibiting characteristics as good as those of the magnetic coating compositions obtained in Example 4 and Example 5 could not be obtained. As for the magnetic characteristics of the magnetic tape webs, the magnetic tape webs obtained in Example 4 and Example 5 exhibited a maximum magnetic flux density (Bm), a residual magnetic flux density (Br), and a Br/Bm ratio which were higher than those of the magnetic tape web obtained in Comparative Example 2. This would be because, in Example 4 and Example 5, a high shearing force was given to the mixture during the dilution kneading process. As a result, the maximum magnetic flux density (Bm) increased, and good dispersing quality was obtained, so that the Br/Bm ratio became high and the residual magnetic flux density (Br) increased. Also, as will be clear from Table 4, the same effects could be obtained when the diameter of each paddle, the width of the gap between each pair of paddles, which were secured to different shafts and which faced each other, and the width of the gap between each paddle and the inner surface of the barrel were changed in Example 6. Additionally, it was revealed that good results could be obtained when the solids concentration in the mixture subjected to the normal kneading process fell within the range of 65 to 95 wt%, and the solids concentration in the mixture subjected to the dilution kneading process fell within the range of 30 to 60 wt%.

We claim:

1. A method for preparing a magnetic coating composition wherein a single two-shaft continuous kneading and mixing machine, which is provided with a pair of shafts having blade members secured thereto and a barrel accommodating the shafts such that they can rotate, is used to carry out normal kneading of a mixture of magnetic grains and a solution which contains a binder in an organic solvent in a normal kneading region and thereafter to carry out dilution kneading of the mixture, which results from normal kneading, and an organic solvent in a dilution kneading region, wherein the improvement comprises the steps of:

(i) in the course of said normal kneading being carried out, adjusting the solids concentration in the mixture subjected to said normal kneading so that the solids concentration falls within the range of 65 to 95 wt%, (ii) in the course of said dilution kneading being carried out, adjusting the solids concentration in the mixture subjected to said dilution kneading so that the solids concentration falls within the range of 30 to 60 wt%, (iii) adjusting the widths of gaps in said dilution kneading region of said two-shaft continuous kneading and mixing machine, each of which gaps is formed between a blade member secured to one of said shafts and a blade member secured to the other shaft, said blade members being positioned such that they face each other, so that they are smaller than the widths of such gaps in said normal kneading region of said two-shaft continuous kneading and mixing machine, and (iv) adjusting the widths of gaps in said dilution kneading region of said two-shaft continuous kneading and mixing machine, each of which gaps is formed between each blade member and the inner surface of said barrel, so that they are smaller than the widths of such gaps in said normal kneading region of said two-shaft continuous kneading and mixing machine.

2. A method as defined in claim 1 wherein the solids concentration in the mixture subjected to said normal kneading falls within the range of 75 to 90 wt%.

3. A method as defined in claim 1 wherein the solids concentration in the mixture subjected to said dilution kneading falls within the range of 40 to 55 wt%.

4. A method as defined in claim 1 wherein the widths of gaps in said dilution kneading region of said two-shaft continuous kneading and mixing machine, each of which gaps is formed between a blade member secured to one of said shafts and a blade member secured to the other shaft, said blade members being positioned such that they face each other, are adjusted so that they fall within the range of 50% to 80% of the widths of such gaps in said normal kneading region of said two-shaft continuous kneading and mixing machine.

5. A method as defined in claim 1 wherein the widths of gaps in said dilution kneading region of said two-shaft continuous kneading and mixing machine, each of which gaps is formed between each blade member and the inner surface of said barrel, are adjusted so that they fall within the range of 50% to 80% of the widths of such gaps in said normal kneading region of said two-shaft continuous kneading and mixing machine.

6. A method as defined in claim 1 wherein the widths of gaps in said normal kneading region of said two-shaft continuous kneading and mixing machine, each of which gaps is formed between a blade member secured to one of said shafts and a blade member secured to the other shaft, said blade members being positioned so that they face each other, fall within the range of 0.5 mm to 4 mm.

7. A method as defined in claim 1 wherein the widths of gaps in said normal kneading region of said two-shaft continuous kneading and mixing machine, each of which gaps is formed between each blade member and the inner surface of said barrel, fall within the range of 0.5 mm to 4 mm.

8. A method as defined in claim 1 wherein the diameter of the circular path, along which a tip of each of said blade members located in said normal kneading region rotates, falls within the range of 50 mm to 400 mm.

9. A method for preparing a magnetic coating composition wherein a first one of two two-shaft continuous kneading and mixing machines, each of which is provided with a pair of shafts having blade members secured thereto and a barrel accommodating the shafts such that they can be rotated, is used to carry out normal kneading of a mixture of magnetic grains and a solution which contains a binder in an organic solvent, and a second one of the two two-shaft continuous kneading and mixing machines is used to carry out dilution kneading of a mixture, which results from normal kneading, and an organic solvent, wherein the improvement comprises the steps of:

(i) in the course of said normal kneading being carried out in said first two-shaft continuous kneading and mixing machine, adjusting the solids concentration in the mixture subjected to said kneading so that the solids concentration falls within the range of 65 to 95 wt%, (ii) in the course of said dilution kneading being carried out in said second two-shaft continuous kneading and mixing machine, adjusting the solids concentration in the mixture subjected to said dilution kneading so that the solids concentration falls within the range of 30 to 60 wt%, (iii) adjusting the widths of gaps in said second two-shaft continuous kneading and mixing machine, each of which gaps is formed between a blade member secured to one of said shafts and a blade member secured to the other shaft, said blade members being positioned such that they face each other, so that they are smaller than the widths of such gaps in said first two-shaft continuous kneading and mixing machine, and (iv) adjusting the widths of gaps in said second two-shaft continuous kneading and mixing machine, each of which gaps is formed between each blade member and the inner surface of said barrel, so that they are smaller than the widths of such gaps in said first two-shaft continuous kneading and mixing machine.

10. A method as defined in claim 9 wherein the solids concentration in the mixture subjected to said normal kneading falls within the range of 75 to 90 wt%.

11. A method as defined in claim 9 wherein the solids concentration in the mixture subjected to said dilution kneading falls within the range of 40 to 55 wt%.

12. A method as defined in claim 9 wherein the widths of gaps in said second two-shaft continuous kneading and mixing machine, each of which gaps is formed between a blade member secured to one of said shafts and a blade member secured to the other shaft, said blade members being such that they face each other, are adjusted so that they fall within the range of 50% to 80% of the widths of such gaps in said first two-shaft continuous kneading and mixing machine.

13. A method as defined in claim 9 wherein the widths of gaps in said second two-shaft continuous kneading and mixing machine, each of which gaps is formed between each blade member and the inner surface of said barrel, are adjusted so that they fall within the range of 50% to 80% of the widths of such gaps in said first two-shaft continuous kneading and mixing machine.

14. A method as defined in claim 9 wherein the widths of gaps in said first two-shaft continuous kneading and mixing machine, each of which gaps is formed between a blade member secured to one of said shafts and a blade member secured to the other shaft, said blade members being positioned such that they face each other, fall within the range of 0.5 mm to 4 mm.

15. A method as defined in claim 14 wherein the widths of said gaps in said first two-shaft continuous kneading and mixing machine fall within the range of 0.6 mm to 3 mm.

16. A method as defined in claim 9 wherein the widths of gaps in said first two-shaft continuous kneading and mixing machine, each of which gaps is formed between each blade member and the inner surface of said barrel, fall within the range of 0.5 mm to 4 mm.

17. A method as defined in claim 16 wherein the widths of said gaps in said first two-shaft continuous kneading and mixing machine fall within the range of 0.6 mm to 3 mm.

18. A method as defined in claim 9 wherein the diameter of the circular path, along which a tip of each of said blade members located in said first two-shaft continuous kneading and mixing machine rotates, falls within the rang of 50 mm to 400 mm.

* * * * *